US008317474B1

(12) United States Patent
Liang

(10) Patent No.: US 8,317,474 B1
(45) Date of Patent: Nov. 27, 2012

(54) TURBINE BLADE WITH NEAR WALL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 465 days.

(21) Appl. No.: 12/689,285

(22) Filed: Jan. 19, 2010

(51) Int. Cl.
*F01D 5/18* (2006.01)
*F01D 5/08* (2006.01)

(52) U.S. Cl. ..... 416/97 R; 416/95; 416/96 R; 415/115; 415/116

(58) Field of Classification Search ..... 415/115, 415/116; 416/95, 96 R, 97 R
See application file for complete search history.

(56) References Cited

U.S. PATENT DOCUMENTS

| | | | | |
|---|---|---|---|---|
| 3,819,295 | A | 6/1974 | Hauser et al. | |
| 3,934,322 | A | 1/1976 | Hauser et al. | |
| 4,203,706 | A * | 5/1980 | Hess | 416/97 A |
| 5,370,499 | A | 12/1994 | Lee | |
| 6,382,907 | B1 * | 5/2002 | Bregman et al. | 415/115 |
| 7,753,650 | B1 * | 7/2010 | Liang | 416/97 R |

* cited by examiner

*Primary Examiner* — Ninh H Nguyen
*Assistant Examiner* — William Grigos
(74) *Attorney, Agent, or Firm* — John Ryznic

(57) ABSTRACT

An air cooled turbine blade with an array of sinusoidal shaped chordwise extending cooling air passages that start from a leading edge of the airfoil and extend to the trailing edge on both the pressure side and suction side walls. The sinusoidal shaped cooling channels on the pressure side merge with the sinusoidal shaped cooling channels on the suction side in a trailing edge region cooling channel and exit the blade through a row of trailing edge exit holes. Cooling air from a forward cooling supply cavity provides impingement cooling air for the leading edge that then flows into the sinusoidal shaped cooling channels.

6 Claims, 4 Drawing Sheets

TURBINE BLADE WITH NEAR WALL COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically for an air cooled turbine blade.

2. Description of the Related Art Including Information Disclosed Under 37 CFR 1.97 and 1.98

A gas turbine engine includes a turbine with one or more stages of stator vanes and rotor blades that react with a hot gas flow to produce mechanical work. The turbine, and therefore the engine, efficiency can be increased by passing a higher temperature gas flow into the turbine. However, the highest turbine inlet temperature is limited to the material properties of the turbine, especially for the first stage airfoils (vanes and blades) since these are exposed to the highest temperatures in the turbine.

One way to allow for higher turbine inlet temperatures is to provide for improved cooling of the airfoils. A large amount of cooling air could be used, but the work used to compressor the cooling air is done by the engine itself in the compressor. Thus, turbine airfoil designers try to maximize the cooling capability of the airfoils while using a minimal amount of cooling air. FIG. 1 shows a prior art blade with a near wall cooling design formed in the airfoil main body with radial cooling air channels plus resupply holes in conjunction with film discharge cooling holes. cooling air from a cooling air supply cavity formed within the airfoil main body is metered through metering holes to produce impingement cooling in the radial extending cooling channels to cool the backside surface of the pressure side and suction side walls, and then discharges the spent impingement cooling air through rows of film cooling holes to provide a layer of film cooling air onto the external surface of the airfoil. A row of trailing edge exit holes connects to the cooling supply cavity to provide convection cooling for the trailing edge region. In the prior art FIG. 1 airfoil cooling design, the spanwise and chordwise cooling flow control due to airfoil external hot gas temperature and pressure variations is difficult to achieve. In addition, a single pass radial channel flow is not the best method of utilizing cooling air and results in a low convection cooling effectiveness.

BRIEF SUMMARY OF THE INVENTION

An improvement for the airfoil near wall cooling of the prior art can be achieved with the near wall chordwise flowing cooling circuit of the present invention that includes sinusoidal shaped chordwise extending ribs formed along the pressure side wall and suction side wall of the airfoil that extends from the leading edge and extends to the trailing edge region. Each of the sinusoidal shaped cooling channels is connected to a cooling air feed hole located in the leading edge region. The sinusoidal shaped cooling channels on the pressure side wall merge with the sinusoidal shaped cooling channels on the suction side wall in the trailing edge region in which the peaks of the pressure side channels are opposed to the valleys of the suction side channels to form a criss-cross pattern of sinusoidal shaped ribs. The merged sinusoidal shaped cooling channels discharge along the trailing edge of the airfoil. The sinusoidal shaped cooling channels are formed on a main spar structure and enclosed by a thin thermal skin that forms the outer airfoil surface.

DETAILED DESCRIPTION OF THE INVENTION

Figure 1:
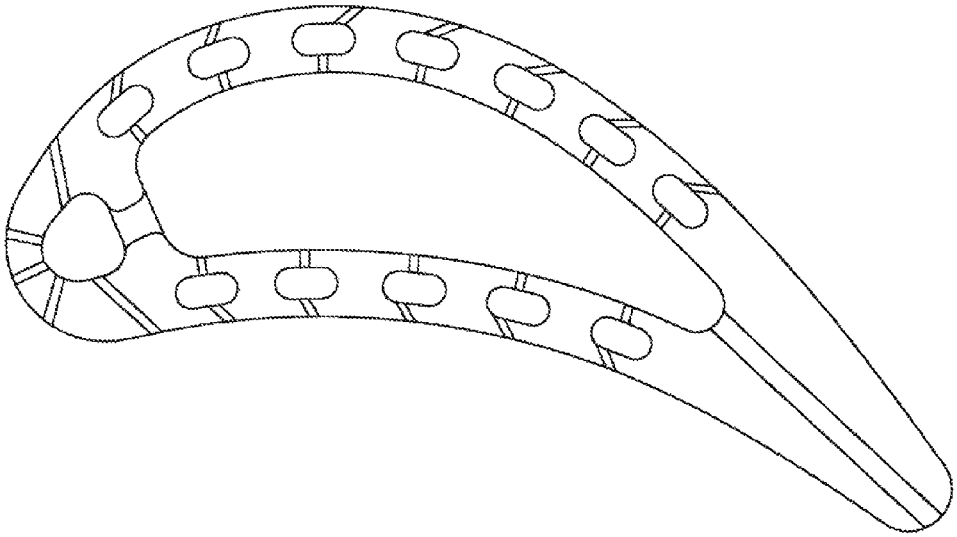
Fig 1 Prior Art
FIG. 1 shows a cross section of a prior art near wall cooling circuit for a turbine airfoil.
Figure 2:
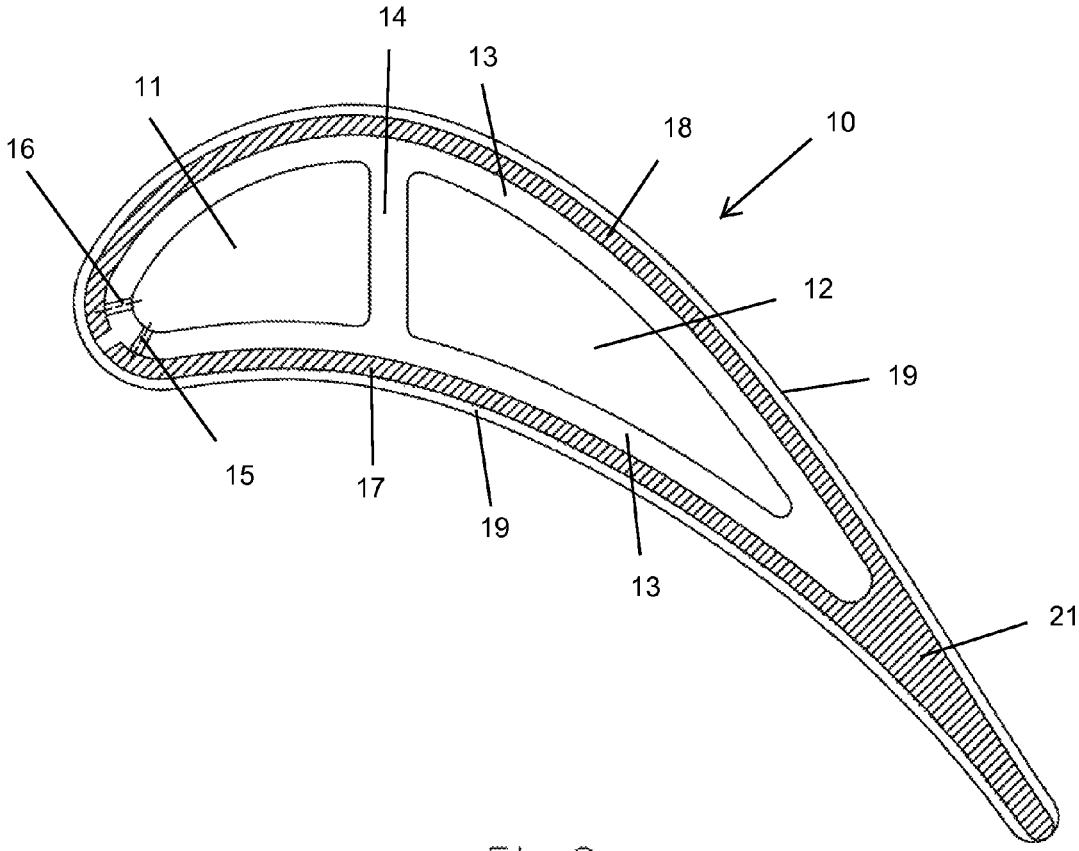
FIG. 2 shows a cross section view of the near wall cooling circuit in the turbine airfoil of the present invention.

A turbine blade 10 for use in a gas turbine engine is shown in FIG. 2 and includes a main spar 13 having the general shape of an airfoil with a leading edge and a trailing edge and a pressure side wall and a suction side wall extending between the two edges. Two or more internal cavities 11 and 12 are formed by a rib 14 extending across the cavity from the S/S wall to the P/S wall of the main spar 13. The forward most cavity is a cooling air supply cavity 11 while the aft most cavity 12 is an empty cavity. A thin thermal skin 19 is bonded to the main spar 13 to form the outer airfoil surface. The thermal skin 19 can be one piece to cover the entire airfoil portion of the blade 10, or can be made from several smaller pieces that combined will cover the entire airfoil surface.

Formed between an outer surface of the main spar 13 and the thin thermal skin 19 is a sinusoidal shaped chordwise extending ribs that start at the leading edge and end at the trailing edge. One arrangement of sinusoidal shaped ribs 17 is formed on the pressure wall side of the airfoil and another arrangement of sinusoidal shaped ribs 18 is formed on the suction side wall of the airfoil. A row of leading edge film holes 15 supplies cooling air from the cooling air supply cavity 11 to the sinusoidal ribs on the pressure side wall. A row of suction side film holes 16 supplies cooling air from the cooling air supply cavity 11 to the sinusoidal ribs on the suction side wall. The sinusoidal shaped ribs open onto the trailing edge of the airfoil through a row of exit holes 22 in the trailing edge. the sinusoidal shaped flow channels 17 on the pressure side wall are separated from the sinusoidal shaped flow channels 18 on the suction side wall by a leading edge rib so that different pressure or flows of cooling air can be designed on the P/S and S/S cooling channels. The two merged sinusoidal flow cooling channels in the trailing edge region decrease in width from the P/S wall to the S/S wall and increase the cooling air flow in the direction of the T/E exit holes 22.

Figure 3:
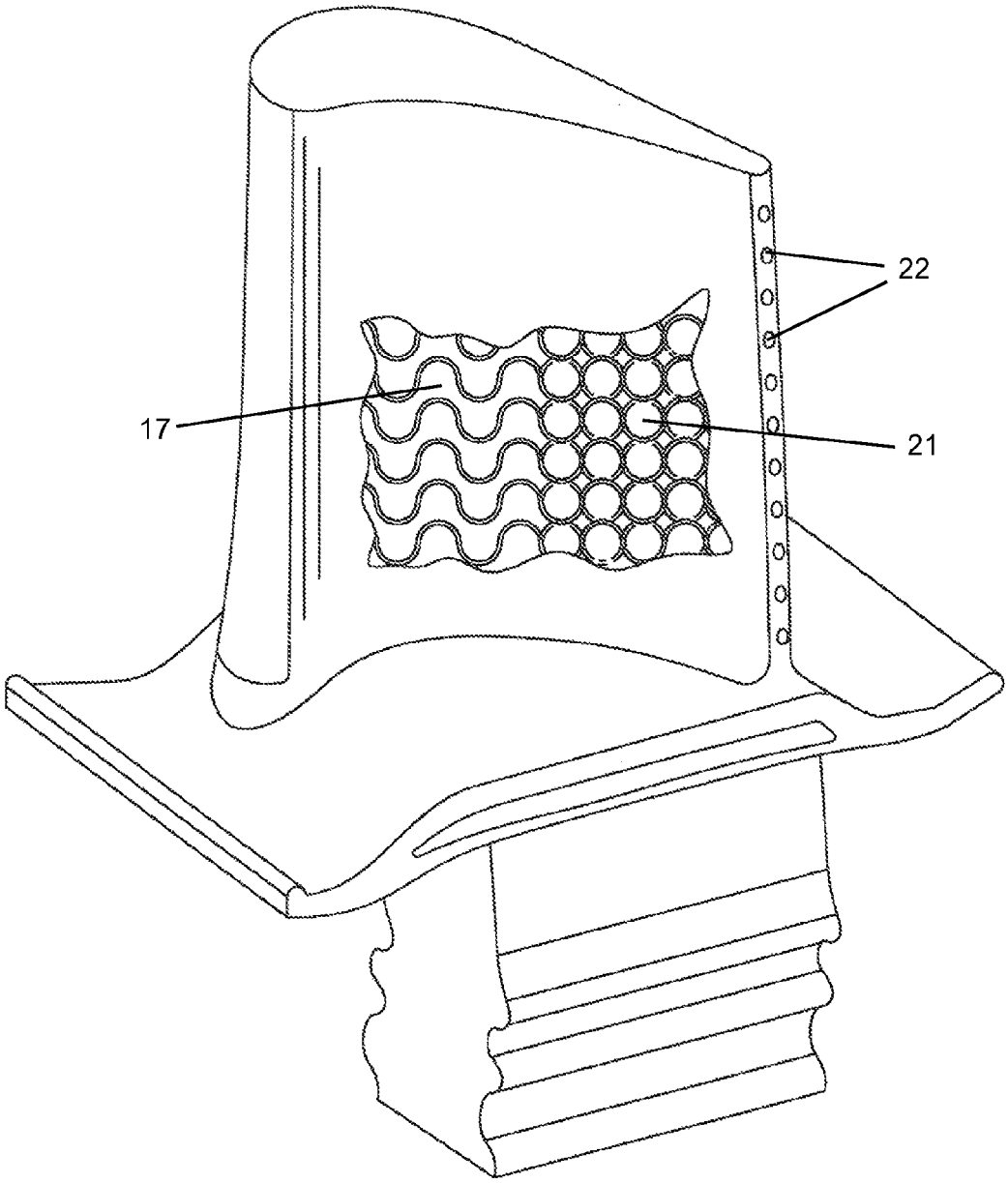
FIG. 3 shows a schematic view of the turbine blade with the sinusoidal shaped cooling channels of the present invention with a cut-away view of the pressure side wall channels and the trailing edge region channels.

FIG. 3 shows the turbine blade 10 with a cut-away view of the sinusoidal ribs on the pressure wall side of the main spar 13. In the trailing edge region, the sinusoidal ribs 17 of the P/S wall merge with the sinusoidal ribs 18 from the S/S wall but offset so that the peaks of the P/S ribs are opposed to the valleys of the S/S ribs. The row of T/E exit holes 22 are shown in FIG. 3 and are connected to the sinusoidal cooling air passages formed by the two sinusoidal shaped ribs that are merged in the trailing edge region.

Figure 4:
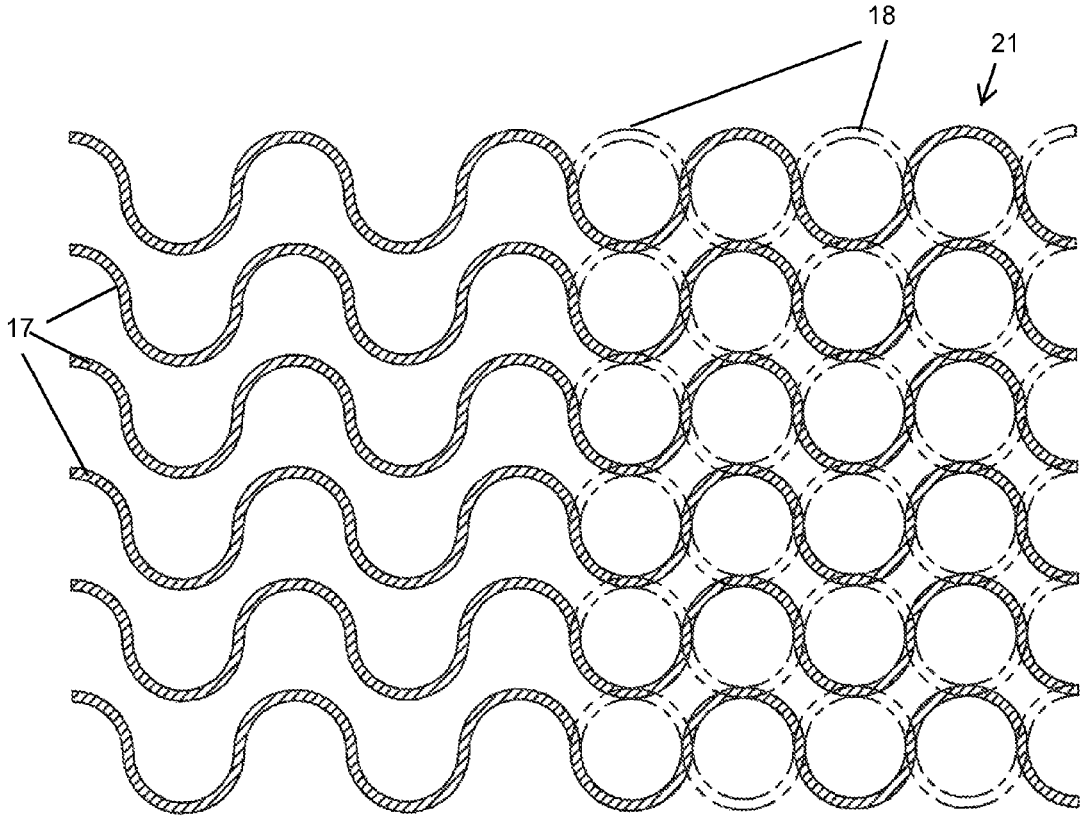
FIG. 4 shows a cut-away view of the pressure side wall sinusoidal shaped cooling channels that merge into the suction side wall sinusoidal shaped cooling channels in the trailing edge region of the airfoil.

FIG. 4 shows a cross section side view of the P/S wall sinusoidal shaped ribs 17 that merge with the S/S wall sinusoidal shaped ribs 18 in the trailing edge region 21. FIG. 4 shows how the peaks of the P/S sinusoidal shaped ribs 17 are opposed to the valleys of the S/S wall sinusoidal ribs 18. This arrangement in the T/E region creates additional turbulent flow for the cooling air.

At the blade mid-chord region where the blade contains the highest thickness, near wall cooling is used for a reduction of the cooling flow cross sectional area. A single half near wall cooling channel for the blade mid-chord section is used to increase the cooling flow velocity and subsequently to increase the cooling side internal heat transfer coefficient. However, at the blade trailing edge region where the blade geometry is very thin, an individual separated near wall sinusoidal channel for both the pressure side and suction side walls becomes unfeasible. Therefore, for the blade trailing edge region, the sinusoidal shaped flow channels from the pressure side wall and the suction side wall merge together to form a single flow channel but with opposed sinusoidal shaped channels offset so that peaks of one are aligned with valleys of the other.

The sinusoidal flow is created by forcing the cooling air within the chordwise flow channels to flow in a sinusoidal type of motion from the leading edge to the trailing edge. The sinusoidal shaped ribs and channels can be cast into the airfoil wall or machined after the main spar has been cast. The sinusoidal shaped ribs on the P/S wall will offset to the sinusoidal shaped ribs on the S/S wall.

In operation, cooling air flow is delivered from the leading edge section through the rows of metering holes 15 and 16 from the supply cavity 11 to produce backside impingement cooling of the pressure side and suction side cooling flow channels in the leading edge region. The cooling air will then flow through the sinusoidal shaped cooling channels formed by the sinusoidal shaped ribs along the P/S wall cooling channels 17 and the S/S wall cooling channels 18 to provide near wall cooling to the mid-chord section of the airfoil. In the trailing edge region the two sinusoidal shaped cooling channels 17 and 18 merge to form one cooling channel in which the cooling air from the P/S channels will mix with the cooling air from the S/S channels. The combined effect of the sinusoidal flow and the mixing creates a spiral flow pattern toward the blade T/E exit holes 22. The sinusoidal flow pattern generates an extremely high turbulent level of coolant flow and thus generates a high internal heat transfer coefficient.

In constructing the near wall cooled turbine blade of the present invention, the blade main spar 13 can be cast with the open cavities 11 and 12. The sinusoidal shaped ribs and channels can be cast along with the main spar or machined after the main spar has been cast. The thermal skin 19 can be of a different material than the main spar 13 or of the same material and can be bonded to the main spar by a transient liquid phase (TLP) bonding process. The thin thermal skin 19 can be formed in multiple pieces or as a single piece to form the entire airfoil surface. The thermal skin 19 can be formed from a high temperature resistant material (higher than the main spar 13) and in a thin sheet form with a thickness in the order of 0.010 inches to 0.030 inches. This thin thermal skin is very difficult to achieve using present day lost wax (investment) casting processes.

I claim the following:

1. An air cooled turbine airfoil comprising:

a main spar having a pressure side wall surface and a suction side wall surface;

a cooling air supply cavity formed in a forward end of the main spar;

a thin thermal skin secured to the main spar to form an outer airfoil surface of the airfoil;

a plurality of pressure side wall sinusoidal shaped ribs extending in a chordwise direction from the leading edge to the trailing edge of the airfoil and forming pressure wall side sinusoidal shaped cooling channels;

a plurality of suction side wall sinusoidal shaped ribs extending in a chordwise direction from the leading edge to the trailing edge of the airfoil and forming suction wall side sinusoidal shaped cooling channels;

a trailing edge cooling channel formed in a trailing edge region of the airfoil; and, the sinusoidal shaped ribs on the pressure wall side merging with the sinusoidal shaped ribs on the suction wall side with the two sinusoidal shaped ribs offset such that the cooling air flow mixes together.

2. The air cooled turbine airfoil of claim 1, and further comprising:

a first row of metering holes in a leading edge region connects the cooling air supply cavity with the sinusoidal shaped ribs on the pressure side wall; and, a second row of metering holes in a leading edge region connects the cooling air supply cavity with the sinusoidal shaped ribs on the suction side wall.

3. The air cooled turbine airfoil of claim 1, and further comprising:

a row of trailing edge exit holes connects the trailing edge cooling channel to discharge cooling air from the airfoil.

4. The air cooled turbine airfoil of claim 2, and further comprising:

the first and second rows of metering holes are positioned to discharge impingement cooling air onto a backside wall of the leading edge region of the airfoil prior to flowing into the sinusoidal shaped cooling channels.

5. The air cooled turbine airfoil of claim 1, and further comprising:

the airfoil is without film cooling holes.

6. The air cooled turbine airfoil of claim 1, and further comprising:

in the trailing edge region cooling channel, the sinusoidal shaped ribs of the pressure wall side are offset one wavelength from the sinusoidal shaped ribs of the suction wall side.

* * * * *